United States Patent [19]

Crescenzi

[11] Patent Number: 4,580,273

[45] Date of Patent: Apr. 1, 1986

[54] ELECTRICAL INDUCTION CRUCIBLE FURNACE FOR DIE CASTING

[76] Inventor: Giuseppe Crescenzi, Piazza Vittorio Veneto 4, Turin, Italy

[21] Appl. No.: 634,845

[22] Filed: Jul. 26, 1984

[30] Foreign Application Priority Data

Jul. 27, 1983 [IT] Italy ..... 67809 A/83

[51] Int. Cl.[4] ..... H05B 5/00

[52] U.S. Cl. ..... 373/151; 373/155; 373/156; 373/142

[58] Field of Search ..... 373/45, 46, 73, 138, 373/151, 152, 153, 154, 155, 156, 157, 158, 142

[56] References Cited

U.S. PATENT DOCUMENTS 3,162,710 12/1964 Anderson ..... 373/153

3,703,600 11/1972 Scott ..... 373/46

3,811,001 5/1974 Lethen ..... 373/154

*Primary Examiner*—Roy N. Envall, Jr.

*Attorney, Agent, or Firm*—Sughrue, Mion, Zinn, Macpeak, and Seas

[57] ABSTRACT

A furnace comprises a crucible surrounded by an induction heating coil and having a filling mouth and a pouring spout. The crucible is cylindrical in shape having an oval external cross-sectional profile with a major diameter and a minor diameter, and an internal profile of substantially constant diameter. In the portions of the crucible wall of greater thickness are formed a filling duct and a pouring duct which connect the filling mouth and the pouring spout respectively to the bottom of the crucible.

5 Claims, 4 Drawing Figures

ELECTRICAL INDUCTION CRUCIBLE FURNACE FOR DIE CASTING

The present invention relates to a main frequency (50–60 Hz) or medium frequency electrical induction furnace, comprising a crucible surrounded by an induction heating coil and having a filling mouth and a pouring spout connected to the bottom of the crucible through a filling duct and a pouring duct respectively.

The furnace in question may be a furnace for die or vacuum casting, a smelting furnace, a superheating furnace or a holding furnace.

The object of the invention is to provide an induction furnace of the type specified above which has a high thermoelectric efficiency and in which the crucible has a high usable capacity and, further to achieve a greater capacity of the crucible, the filling and pouring ducts have dimensions which are as small as possible without the molten material being able to cool and solidify within these ducts during interruptions of the pouring, when the induction field is maintained at a reduced holding intensity.

In order to achieve this object, according to a more general aspect, the present invention provides an electric furnace of the type defined initially, characterised in that the crucible is substantially cylindrical in shape having an oval external cross-sectional profile with a major diameter and a minor diameter, and an internal profile of substantially constant diameter, and in that the filling and pouring ducts are formed in the portions of the crucible wall of greater thickness, the said coil surrounding also at least in part the filling duct and the pouring duct.

Figure 1:
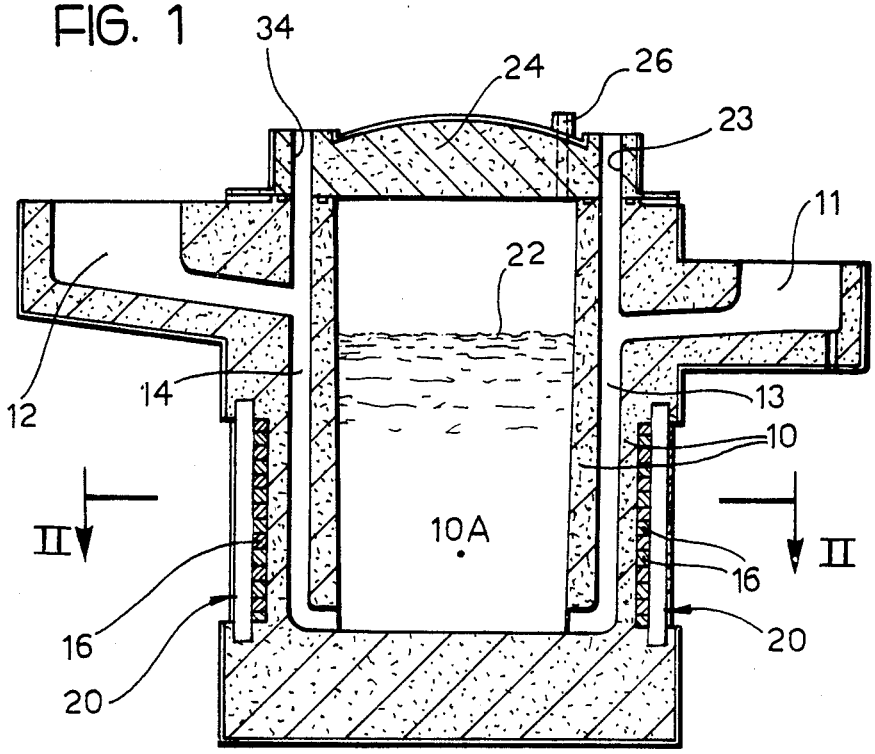
Figure 2:
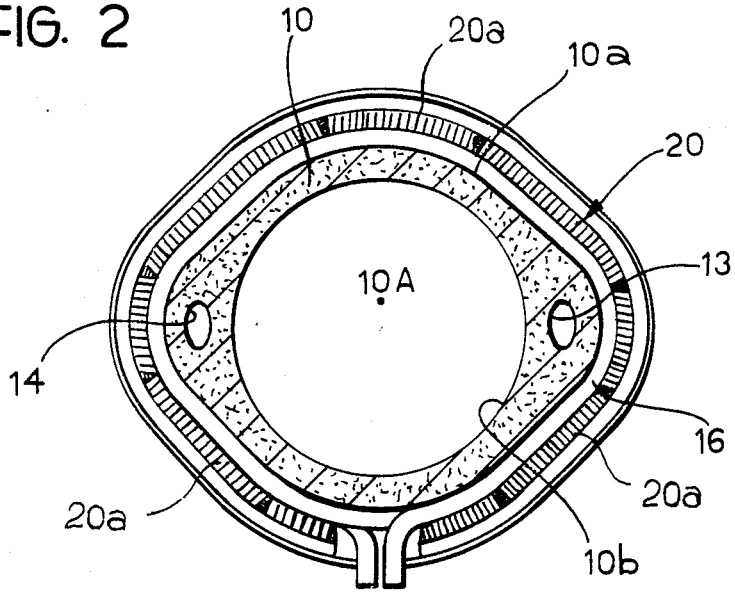
Figure 3:
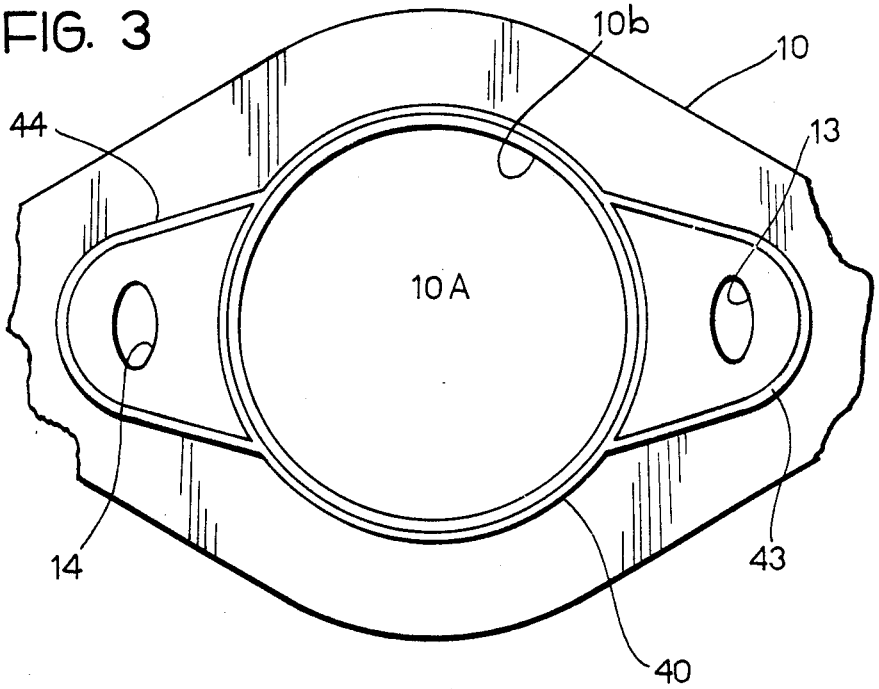
Figure 4:
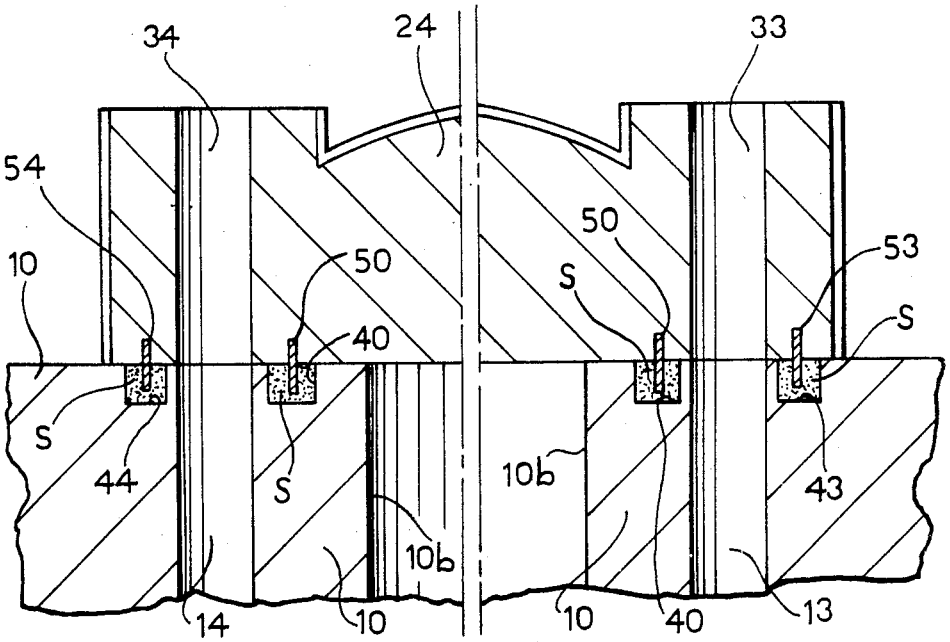

Further objects, characteristics and advantages will become apparent from the following description given with reference to the appended drawings, in which FIG. 1 is a vertical axial section of a furnace according to the invention, FIG. 2 is a horizontal cross-section taken on the line II—II of FIG. 1, FIG. 3 is a plan view of the central portion of the furnace according to the invention, and FIG. 4 shows a detail of FIG. 1 on an enlarged scale.

The furnace illustrated comprises a cylindrical refractory crucible 10 with a pouring spout 11 and a filling or charging mouth 12 diametrally opposite the spout 11. In cross-section, the crucible 10 has an external oval profile 10*a* with a greater diameter and a lesser diameter, and a circular internal profile 10*b*.

In the foregoing and the following, the term "oval" is intended to cover any closed plane curve with two axes of symmetry, which cuts any straight line in the plane at no more than two points.

The openings 11, 12 communicate with the bottom of the crucible 10 through respective vertical ducts 13, 14 formed in the portions of the crucible wall of greater thickness.

These ducts may have an oval or circular cross-section.

The lower part of the crucible is surrounded by a compact induction coil 16 of an electrolytic copper conductor which is suitably insulated and cooled, and follows the oval external profile of the crucible.

A cylindrical shell, indicated 20, is formed by sheets of ferromagnetic material which effectively surround the coil 16 completely. The shell 20 comprises a plurality of packs 20*a* of sheets adjacent one another. With this arrangement, the induction coil 16 causes the heating not only of the metal in the chamber 10A of the crucible but also of that in the ducts 13, 14. The normal level of the molten metal is indicated 22. In the embodiment illustrated, the furnace includes a lid 24 for sealing the crucible 10 and has a connector 26 for the introduction of a pressurised gas for effecting the pouring. The ducts 13, 14 extend up to the upper end face of the crucible. The lid 24 has a pair of apertures 33, 34 aligned axially with these ducts. These apertures allow the level of the molten metal in the furnace to be controlled directly, and the visual inspection and possible cleaning of the ducts 13, 14 and even the filling of the crucible.

Sealing between the lid 24 and the crucible 10 may be achieved in the following manner. A circular groove 40 is formed in the upper end face of the crucible around the upper opening of the crucible. An annular metal strip 50 is embedded in the lid and projects partially from the lower face of the lid. A cementing/sealing material S is introduced into the grove 40 when the lid is fitted onto the crucible so that the strip extends into the cement/sealant in the groove.

It is also possible to form further grooves 43, 44 on the upper end face of the crucible which, together with the groove 40, encircle the ducts 13, 14 (FIG. 3). Two further strips 53, 54 are also embedded in the lid 24 for setting in the cement/sealant introduced into the additional grooves 43, 44.

The furnace described above has a very high capacity as a result of the circular cylindrical form of the melting chamber 10A. Moreover, the ducts 13, 14 are located in the zone of highest concentration of the magnetic flux and hence may be formed with a relatively small diameter so as to favour the dimensions of the chamber 10A of the crucible without the risk of molten material contained therein being able to cool and solidify during interruptions of the pouring, when the induction field is kept at a reduced holding intensity. The furnace described thus allows the molten metal in the ducts to be kept at a temperature substantially equal to that of the metal within the crucible itself. Even in the case of complete cooling of the mass of metal in the crucible, it is possible subsequently to re-melt the metal in the crucible and in the pouring and filling ducts.

Conveniently, the furnace described above may be provided with a series of support carriages which, as well as allowing the usual transational movement of the furnace back and forth and right to left, allow the furnace to rotate through, for example, 90°, to allow its release from the pouring and ladle-filling position or, indeed, to permit pouring on other lines, or for yet other purposes.

I claim:

1. An electrical furnace comprising a crucible surrounded by an induction heating coil and having a filling mouth and a pouring spout connected to the bottom of the crucible through a filling duct and a pouring duct respectively, wherein the crucible is substantially cylindrical in shape having an oval external cross-sectional profile with a major diameter and a minor diameter, and an internal profile of substantially constant diameter, and the filling and pouring ducts are formed in the portions of the crucible wall of greater thickness, the said coil surrounding also at least in part the filling duct and the pouring duct.

2. A furnace according to claim 1, further including a lid, wherein the pouring and filling ducts extend up to the upper end face of the crucible, the lid being formed with first and second inspection apertures in respective positions corresponding to the respective positions of the pouring and filling ducts so that, when the lid is in its closed position, the apertures are aligned axially with the ducts.

3. A furnace according to claim 2, wherein sealing means are provided between the lid and the upper end face of the crucible which extend along a closed line about the internal profile of the crucible and along first and second arcuate curves having respective ends connected to the closed line and encircling, together with the closed line, the apertures of the pouring duct and filling duct respectively.

4. A furnace according to claim 1, wherein the ducts have oval sections.

5. A furnace according to claim 1, wherein the said coil is surrounded by a continuous shell formed by a plurality of packs of ferromagnetic sheets.

* * * * *